US010843255B2

(12) United States Patent
Baranzke et al.

(10) Patent No.: US 10,843,255 B2
(45) Date of Patent: Nov. 24, 2020

(54) FOUNDRY CORE

(71) Applicant: Nemak, S.A.B. de C.V., Garcia (MX)

(72) Inventors: Matthias Baranzke, Rehlingen-Siersburg (DE); Ingo Staudt, Schmelz (DE)

(73) Assignee: Nemak, S.A.B. de C.V., Garcia (MX)

( * ) Notice: Subject to any disclaimer, the term of this patent is extended or adjusted under 35 U.S.C. 154(b) by 0 days.

(21) Appl. No.: 16/497,170

(22) PCT Filed: Mar. 28, 2018

(86) PCT No.: PCT/IB2018/000316
§ 371 (c)(1),
(2) Date: Sep. 24, 2019

(87) PCT Pub. No.: WO2018/178762
PCT Pub. Date: Oct. 4, 2018

(65) Prior Publication Data

US 2020/0316677 A1 Oct. 8, 2020

(30) Foreign Application Priority Data

Mar. 29, 2017 (DE) ..... 10 2017 106 775

(51) Int. Cl.
*B22C 9/10* (2006.01)

(52) U.S. Cl.
CPC ..... *B22C 9/103* (2013.01); *B22C 9/108* (2013.01)

(58) Field of Classification Search
CPC ..... B22C 9/10; B22C 9/103; B22C 9/108
See application file for complete search history.

(56) References Cited

U.S. PATENT DOCUMENTS

| | | | |
|---|---|---|---|
| 2011/0180227 A1 | 7/2011 | Anglin | |
| 2011/0204205 A1 | 8/2011 | Kamel et al. | |

FOREIGN PATENT DOCUMENTS

| | | | | |
|---|---|---|---|---|
| CN | 105960297 A | | 9/2016 | |
| DE | 2746233 A1 | | 4/1978 | |
| DE | 102007002208 A1 | | 8/2007 | |
| DE | 102010047952 A1 | | 4/2012 | |
| DE | 102010054496 A1 | * | 6/2012 | ..... H02K 5/20 |
| EP | 0752291 A1 | | 1/1997 | |
| EP | 1857198 A1 | | 11/2007 | |
| GB | 1534488 | | 10/1977 | |
| JP | 200353478 A | | 2/2003 | |
| JP | 2015044217 A | * | 3/2015 | ..... B22C 7/06 |

* cited by examiner

*Primary Examiner* — Kevin E Yoon
(74) *Attorney, Agent, or Firm* — The Webb Law Firm

(57) ABSTRACT

The present invention relates to a foundry core, which has the base form of a hollow body, with the foundry core being formed from a moulding material consisting of a mixture which is formed from a moulding sand and a binder and optionally from additives added to set its properties and a method for its manufacture. The foundry core according to the invention can be easily manufactured. This is achieved as a result of the foundry core being divided into at least two sub-segments and forming elements interacting with one another in a positive-locking manner being provided on the edge sides, with which sub-segments arranged adjacent to one another abut on one another, or in proximity to these edge sides, via which forming elements the sub-segments arranged adjacent to one another are fixed by positive locking immovably against one another at least in one direction.

7 Claims, 3 Drawing Sheets

FOUNDRY CORE

CROSS-REFERENCE TO RELATED APPLICATIONS

This application is the United States national phase of International Application No. PCT/IB2018/000316 filed Mar. 28, 2018, and claims priority to German Patent Application No. 10 2017 106 775.2 filed Mar. 29, 2017, the disclosures of which are hereby incorporated by reference in their entirety.

BACKGROUND OF THE INVENTION

Field of the Invention

The invention relates to a foundry core, which has the base form of a hollow body, with the foundry core being shaped from a moulding material consisting of a mixture which is formed from a moulding sand and a binder and optionally from additives added to set its properties.

Description of Related Art

Foundry cores of the type in question here serve for the foundry-related manufacture of cast parts made of a metal melt. In the respective cast part, the foundry cores form cavities, such as channels or chambers. These cavities can be provided to save weight. However, a fluid generally flows through them during practical use.

In order to be able to remove the foundry cores after the solidification of the basting materials from the cast part, they are inserted as so-called "lost cores". For manufacturing, the moulding material mixture mixed in the manner explained above is introduced (shot) at high pressure into the mould cavity of a core shooting device. The flowability of the moulding material, the shooting pressure and the positions at which the moulding material is introduced into the mould cavity of the machine provided to manufacture the cores, are matched such that a complete filling of the mould is achieved even in the case of particularly fine-particle cores. After shooting the core, the cores are hardened by applying heat or gassing with a reaction gas such that they can be removed from the core shooting machine and introduced into the respective casting mould where they withstand the stresses occurring when draining the metal melts.

Typical examples of cast parts in which such channels and cavities are formed by means of foundry cores are housings for drive machines which have to be cooled during operation. In such machine housings, so-called "cooling sheaths" are generally provided, i.e. a system of channels surrounding the region of the machine in which heat develops during operation as a result of energy metabolism. In order to ensure an optimal throughflow of the critical regions of the machine and in this manner to ensure a maximum cooling effect with small dimensions, the highest requirements are set for the quality of the surfaces of the channels formed in each case by the foundry core.

The particular challenge with the manufacture of foundry cores of the type in question here is that the foundry cores generally do not form a solid body, but rather are interrupted at multiple points such that their walls form finely broken-down structures, which can comprise islands, in which larger quantities of core materials are collected, larger and thicker tracks, finely branched webs, larger bridges and other delicately shaped forming elements. Owing to the circumferentially closed base structure of the foundry cores typically circular or ellipsoidal in cross-section, the removal of the cores from the core shooting machine is only possible with significant effort with such finely broken-down foundry cores. Thus, complex slider constructions and the like must be provided in order to be able to separate the forming components of the core shooting machine from the finished core in spite of the large number of undercuts and breakthroughs. Aside from the high costs involved with such complex machines, this complexity makes a large-scale technical, quickly-clocked series manufacture of foundry cores of the type in question here more difficult.

A foundry core for the manufacture of a turbine blade is known from US 2011/204205 A1. This foundry core is shaped from a moulding material, which is for example mixed from ceramic particles and a suitable binder. In this case, the foundry core is composed of two sub-segments, which have forming elements interacting with one another in a positive-locking manner at the edge sides, with which they abut on one another, via said forming elements the sub-segments arranged adjacent to one another are fixed immovably against one another by positive locking in two spatial directions, namely in a direction aligned normal to the outside of the segments and a direction aligned transverse thereto in the longitudinal direction of the segments.

Similarly, a foundry core is known from EP 1 857 198 A1, which is composed of sub-segments, which are shaped from a moulding material and in the case of a composed foundry core are coupled to one another in a positive-locking manner via projections and recesses engaging into one another and formed thereon.

Against the background of the previously explained prior art, the object has emerged of designing a foundry core corresponding in its base form to a hollow body, which allows simple manufacture.

SUMMARY OF THE INVENTION

A foundry core according to the invention, which has the base form of a hollow body, with the foundry core being shaped from a moulding material consisting of a mixture which is formed from a moulding sand and a binder and optionally from additives added to set its properties, is therefore characterised according to the invention in that the foundry core is divided into at least two sub-segments and forming elements interacting with one another in a positive-locking manner are provided on the edge sides, with which sub-segments arranged adjacent to one another abut on one another, or in proximity to these edge sides, via which forming elements the sub-segments arranged adjacent to one another are fixed immovable towards one another at least in one direction by positive locking.

A foundry core according to the invention is thus not manufactured in one piece, but rather composed of two or more sub-segments. Since these individual segments themselves no longer delimit a cavity, they can be manufactured in the conventional core shooting process with simply designed core tools. Complex slider arrangements, as required for representing hollow bodies, are not required for the manufacture of the sub-segments. At the same time, the sub-segments formed according to the invention are also comparatively hard-wearing owing to their delimited spatial extension if they are designed delicately with numerous breakthroughs and the like. This allows the sub-segments to be mounted uncomplicatedly and transported to assemble the foundry core. In this case, the assembly of the foundry core according to the invention can be carried out in the course of the assembly of the entire casting mould, in which it will be used or at a point separated therefrom.

Since the sub-segments of the casting mould according to the invention are fixed in their relative position by the forming elements interacting in a positive-locking manner, it is, on the one hand, ensured that the sub-segments easily find their correct position when assembling the foundry core. On the other hand, it is ensured via the positive-locking coupling that the sub-segments maintain their position during the casting operation even under the load of the melt cast into the casting mould and penetrating the foundry core.

The secure holding of the sub-segments together can be supported in the case of the casting mould according to the invention in that the sub-segments are adhered to one another in the region of the forming elements coupling them together in a positive-locking manner. Alternatively or additionally, it is also possible to use the forming elements to couple the foundry core according to the invention to the other foundry cores or moulding parts of the respective casting mould. Thus, it may for example be expedient to design the forming elements as projections protruding in the radial direction, via which adjacent sub-segments of a foundry core according to the invention are fixed by positive locking immovably against one another in at least one direction. Forming elements designed as projections and fixing the sub-segments in a positive-locking manner against one another allow, for example, a simple coupling of the sub-segments to the forming parts and cores surrounding the foundry core in the casting mould, such as side cores, and therefore simple automatable assembly of the casting mould according to the invention.

After demoulding, the projections formed by the moulding parts provided for the positive-locking mutual fixing of the sub-segments, represent openings on the finished cast part, which lead to the cavities, channels, etc representing the casting mould in the cast part. These openings can be sealed by stops subsequently used and connected with the surrounding material of the cast part for example in a positive-locking manner, e.g. by adhering or welding or in another manner with additive material, for example in a welding operation.

Prior to sealing, the openings represented by the projections can be used to trim a web that is possibly present, which can be formed by metal melts, which is penetrated into the joint between two sub-segments meeting one another. To this end, a suitable machining tool, such as a drill or mill, can be guided through the respective opening.

According to the invention, the foundry core has the base form of a hollow cylinder extending in a longitudinal direction with two end faces opposing one another in the longitudinal direction. The individual sub-segments can be formed in the manner of a shell by correspondingly laid separating joints between the sub-segments in the case of a foundry core designed in such a cylindrical tubular manner. Equally however, it may also be expedient for one or a plurality of sub-segments to be separated from the other sub-segments of the casting mould such that the sub-segments in question are annular. It goes without saying that such an annular design may also be advantageous for all sub-segments of the casting mould if the shaping of the foundry core gives a corresponding course of the separating joints between the sub-segments.

A typical design of a foundry core according to the invention in particular for the manufacture of a cooling sheath of an electrically-operated drive machine is achieved as a result of the foundry core being designed, according to the invention, at least over one section as a strip running in a meandering manner around the space delimited by the foundry core.

As already indicated above, in the case of a foundry core according to the invention, the course of the separating joint between the sub-segments of a foundry core according to the invention is selected in accordance with the course and the arrangement of the structures, which are provided in the region of its wall in order to represent cavities, channels and the like in the cast part. In this case, the separating joint between two adjacent sub-segments can extends at least in sections in the longitudinal direction of the foundry core or run at least in sections in the circumferential direction of the foundry core. A separating joint can also of course change its direction in its course, i.e. over a section in the longitudinal direction of the foundry core and over another section in the circumferential direction and so on. In particular in the case where the foundry core has the form of a cylindrical hollow body, it has been proven to be expedient for the separating plane to extend between at least two sub-segments adjacent to one another from one end face of the foundry core to the other.

It has been found to be particularly suitable for the positive-locking fixing of the sub-segments of a foundry core according to the invention abutting on one another to be designed as forming elements, via which adjacent sub-segments are fixed by positive locking immovably against one another in at least one direction, on the edge side of the first sub-segment a projection is formed and on the edge side of the second sub-segment a recess is formed, which fills the projection of the first sub-segment. The recess can in this case for example be formed as a wedge, cone or half-shell shaped indentation and the projection in the cross-section correspondingly in a wedge or semi-circular shape or formed as a cone. In this manner, the sub-segments to be coupled together precisely find their envisaged relative position via their forming elements interacting with one another in a positive-locking manner in the manner of self-centring when assembling the foundry core.

The core concept of the invention is consequently to break down into sub-segments a complexly shaped foundry core representing a hollow body in its base form, said sub-segments are to be manufactured more easily owing to their design that is no longer spatially closed, but also being fixed against one another in the foundry core via suitably designed forming elements such that a precise representation of the cavities, channels and the like to be formed in each case by the foundry core in the cast part is ensured.

Following this core concept, the method for manufacturing a foundry core according to the invention provides for at least the following work steps:

a) manufacturing the sub-segments of the foundry core, with the sub-segments being separated spatially from one another and physically shaped independently of one another from a moulding material consisting of a forming sand and a binder and optionally additives added to set its properties;

b) joining together the sub-segments manufactured spatially separated from one another to form the foundry core.

"Spatially separated" and "physically independently" in this context means that for each of the sub-segments one suitably-mould cavity is in each case provided in a core shooting machine. This of course includes the possibility important in practice of shaping the sub-segments together and simultaneously in a core shooting box in which a mould cavity is provided for each of the sub-segments. This variant of the method according to the invention allows a cost-effective and time-saving manufacture of respectively one set of sub-segments, which can be composed together to form a foundry core according to the invention.

BRIEF DESCRIPTION OF THE DRAWINGS

The invention is explained in more detail below using a drawing representing an exemplary embodiment. Its figures in each case schematically show in.

DESCRIPTION OF THE INVENTION

Figure 1:
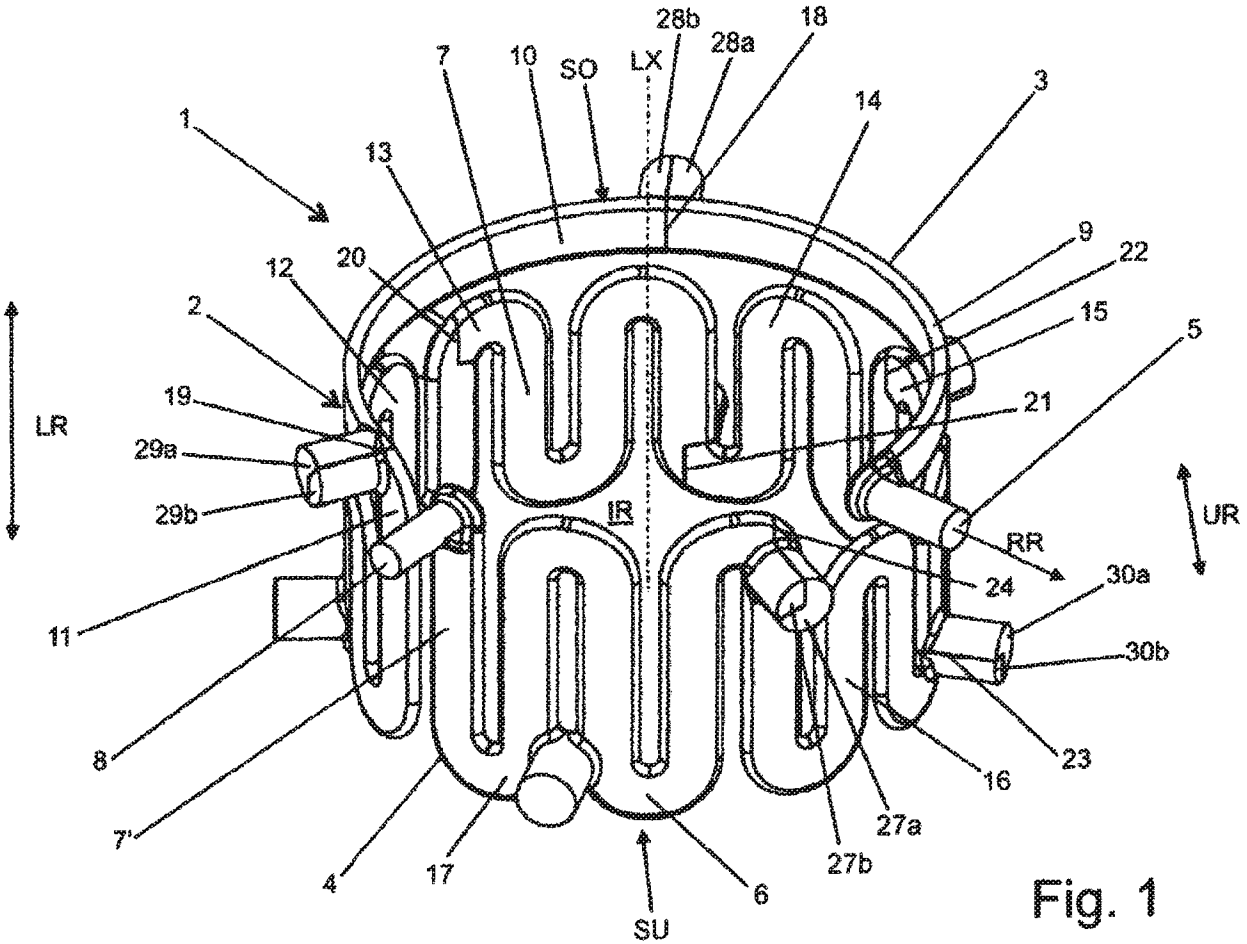
FIG. 1 a foundry core in a perspective view from above.
Figure 2:
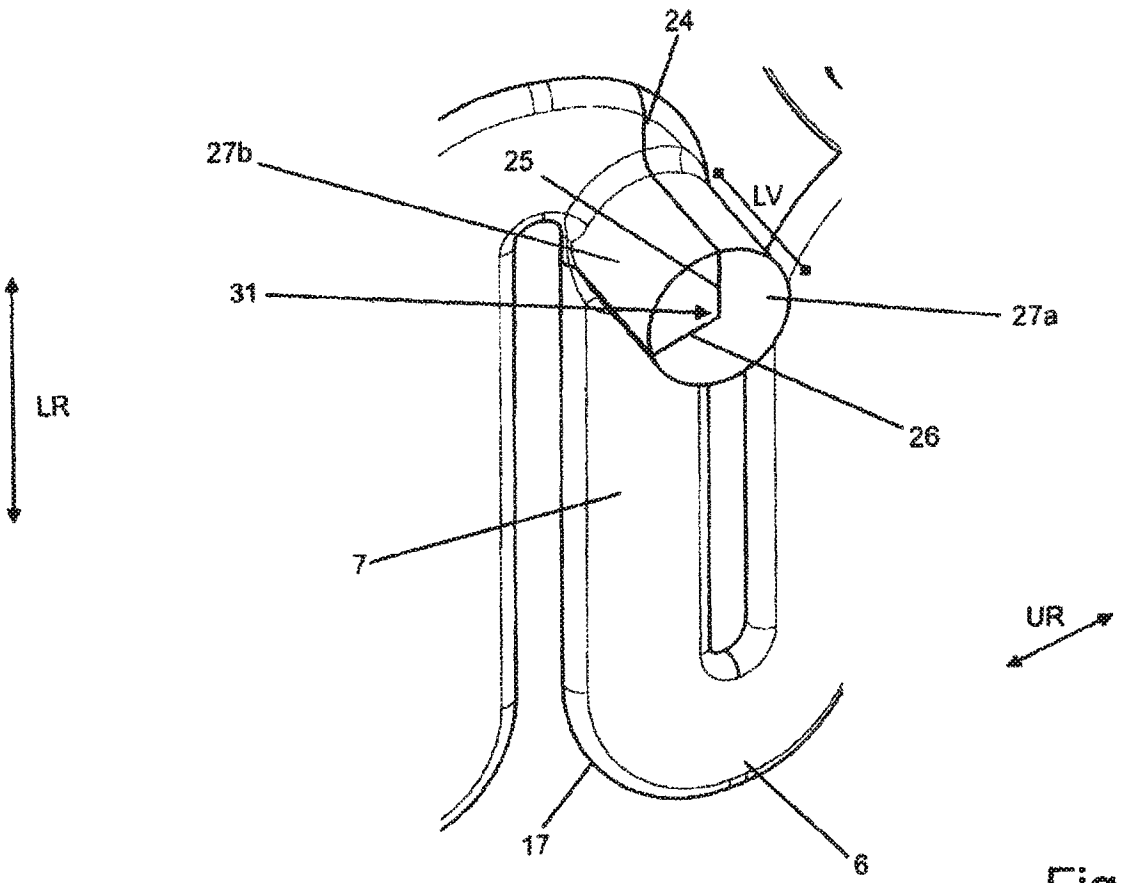
FIG. 2 a section A of the foundry core according to FIG. 1.

The foundry core 1 has the base form of a cylindrical hollow body and accordingly delimits an interior IR, which extends in the longitudinal direction LR from the lower end face SU to the upper end face SO of the foundry core 1.

The foundry core 1 shaped from a moulding material proven for this purpose and mixed from a forming sand and an organic or inorganic binder in a manner known per se serves to represent a cooling water sheath in a housing for an electric motor serving as a vehicle drive, which is cast in a casting mould, not illustrated further here and for example composed as a core packet, made of a light metal melt, such as for example of a conventional aluminium cast material.

The circumferential wall 2 of the foundry core 1 is formed by an annular segment-shaped annular section 3 circulating around the longitudinal axis LX of the foundry core 1 and a meander section 4.

Proceeding from a projection 5 protruding outwards in the radial direction RR and representing an inflow opening in the finished housing, the annular section 3 formed in the manner of a strip with a certain thickness extends over roughly three quarters of the circumference of the foundry core 1.

The start of the meander section 4 is connected to the end of the annular section 3. The windings 6 of the meander section 4 are in each case placed such that their longitudinal sections 7 are axially-parallel to the longitudinal axis LX. In this case, the meander section 4 runs proceeding from the end of the annular section 3 in an opposing direction of the annular section 3 around the interior IR delimited by the foundry core 1 until it arrives, with its end provided at the end of a longitudinal section 7', adjacent to the start of the meander section 4. The projection 8 protruding radially outwardly there forms, in the finished housing, the draining opening of the water sheath to be formed by the foundry core 1.

The foundry core 1 is subdivided into nine sub-segments 9-17. The first sub-segment 9 extends proceeding from the projection 5 over half the length of the annular section 3. The second sub-segment 10 takes in the second half of the annular section 3. The third to ninth sub-segment 11-17 extends in each case over roughly one seventh of the length of the meander section 4, with the ninth sub-segment 17 being longer around the longitudinal section leading to the end of the meander section 4 than the other sub-segments 11-16 of the meander section 4.

The separating joints (of which the separating joints 18-24 are visible in FIG. 1), in which the sub-segments 9, 10; 10, 11; 11, 12; 12, 13; 13; 14; 14; 15; 15, 16; 16; 17 abut against one another, run in each case in a first section 25 in the longitudinal direction LR and in an adjoining section 26 in the circumferential direction UR, and the angle formed between the sections 25 and 26 can be unequal to 90°, the alignment of the section 25 thus can have not only one component in the longitudinal direction LR, but also in the circumferential direction UR and the alignment of the section 26 can have not only one component in the circumferential direction UR, but also in the longitudinal direction LR.

In this case, in the region of each separating joint 18-24 adjoining the edge sides of the sub-segments 9-16 meeting one another in the separating joint 18-24, a forming element 27*a*, 27*b*, 28*a*, 28*b*, 29*a*, 29*b*, 30*a*, 30*b* is designed in the form of a projection protruding radially outwardly. Of the pairs 27*a*, 27*b*; 28*a*, 28*b*; 29*a*, 29*b*; 30*a*, 30*b* of forming elements 27*a*-30*b* formed in such a manner at the separating joints 18-24, one forming element 27*a*, 28*a*, 29*a*, 30*a* has in each case one recess 31 extending over its projection length LV, which is shaped in the manner of a notch shaped in the cross-section corresponding to three-quarters of a circle. The forming elements 27*b*, 28*b*, 29*b*, 30*b* assigned in each case to the forming elements 27*a*, 28*a*, 29*a*, 30*a* are accordingly wedge-shaped with a cross-section that is also in a three-quarter circle shape. In this manner, the forming elements 27*b*, 28*b*, 29*b*, 30*b* in each case fill the recess 31 of the assigned forming elements 27*a*, 28*a*, 29*a*, 30*a* such that projections protruding radially outwardly formed by forming element pairs 27*a*, 27*b*; 28*a*, 28*b*; 29*a*, 29*b*; 30*a*, 30*b* have a cross-section shaped circular as a whole.

Via the forming elements 27*a*-30*b* provided in each case on the sub-segments 9-17 and their edge sides abutting on one another in the region of the separating joints 18-24, the sub-segments 9-17 are fixed in a positive-locking manner in the circumferential direction UR and in the longitudinal direction LR such that a relative movement in the circumferential direction UR and in the longitudinal direction LR is prevented on the lower end face SU.

Figure 3:
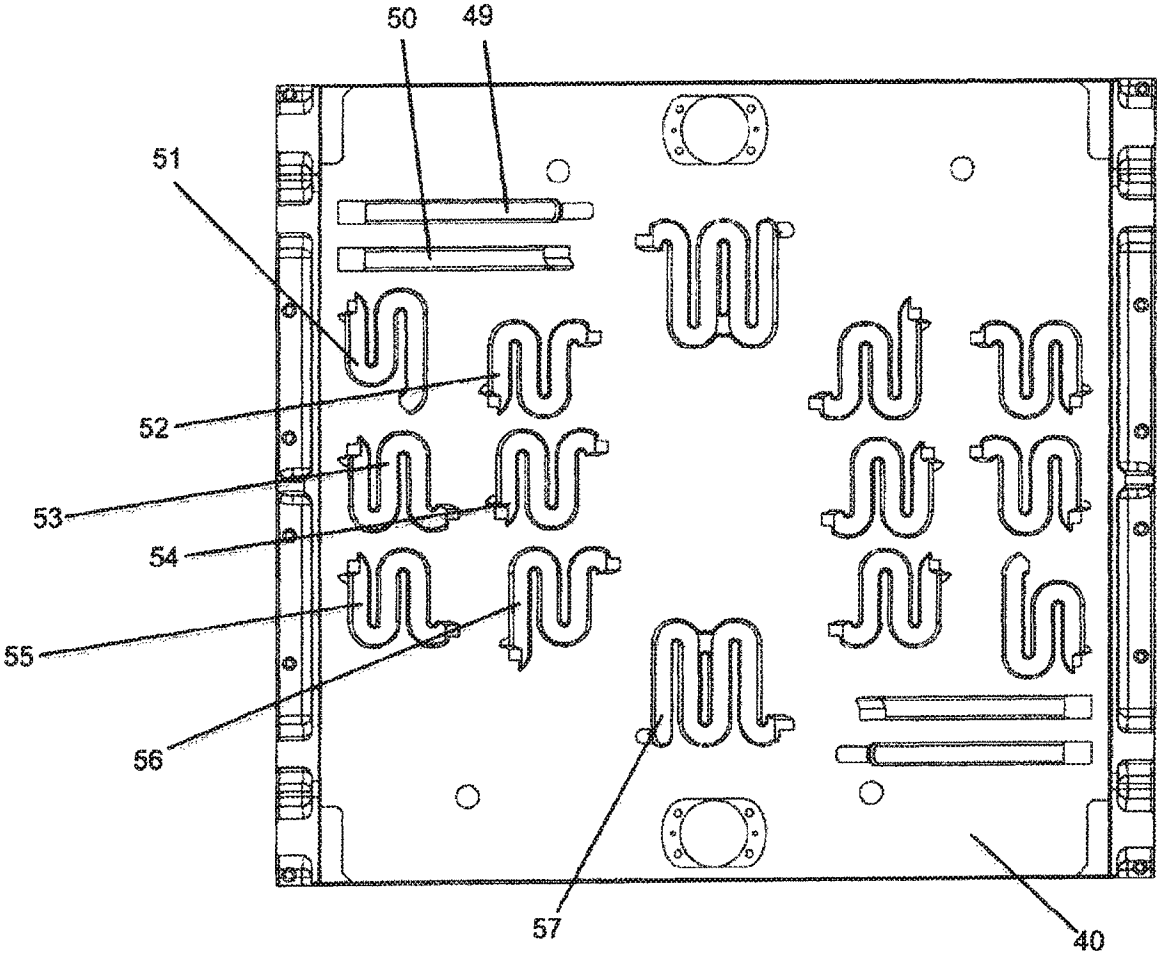
FIG. 3 the lower part of a core shooting box in plan view.

In order to manufacture the annular core 1, a core shooting box is provided of which the lower part 40 is represented in FIG. 3. The core shooting box not shown further here for the sake of clarity is set up such that the sub-segments 9-17 for two identical annular cores 1 can be shot in it. Accordingly, two sets of mould cavities 49-57 spatially separated from one another are formed in a corresponding manner in the lower part 40 of the core shooting box and in the associated upper part of the core shooting box not represented here. After shooting the core box, two sets of sub-segments 9-17 can be hereby shot in a manner known per se. They are then composed to form two annular cores 1. In this case, this composition can take place before the foundry cores 1 are set into the respective casting mould or the sub-segments 9-17 can be composed in the respective casting mould to form the foundry core 1 provided in it.

REFERENCE NUMERALS

1 foundry core
2 circumferential wall of the foundry core 1
3 annular section of the foundry core 1
4 meander section of the foundry core 1
5 projection
6 windings
7, 7' longitudinal sections
8 projection
9-17 sub-segments
18-24 separating joints
25 section of the separating joints running in the longitudinal direction LR
26 section of the separating joints running in the circumferential direction UR

27*a*-30*b* forming elements
31 recess
40 core box lower part
49-57 mould cavities
IR interior delimited by foundry core
LR longitudinal direction of the foundry core 1
LV projection length
UR circumferential direction of the foundry core 1
RR radial direction
SU lower end face of the foundry core 1
SO upper end face of the foundry core 1
LX longitudinal axis of the foundry core 1

The invention claimed is:

1. A foundry core, wherein the foundry core is shaped from a moulding material consisting of a mixture which is formed from a moulding sand and a binder and optionally from additives added to set its properties wherein the foundry core is divided into at least two sub-segments and wherein forming elements interacting with one another in a positive-locking manner are provided on edge sides, with which sub-segments arranged adjacent to one another abut on one another, or in proximity to these edge sides, via the forming elements the sub-segments arranged adjacent to one another are fixed by positive locking immovably against one another at least in one direction, characterised in that the core has a base form of a hollow cylinder extending in a longitudinal direction with two end faces opposed to one another in the longitudinal direction, and in that the core is formed at least over one section as a strip running in a meandering shape around a space delimited by the foundry core.

2. The foundry core according to claim 1, characterised in that the at least two sub-segments are adhered to one another at least in the region of their forming elements fixed against one another in a positive-locking manner.

3. The foundry core according to claim 2, characterised in that separating joint extends between the two sub-segments adjacent to one another from one end face of the foundry core to the other.

4. The foundry core according to claim 1, characterised in that separating joint extends between the two sub-segments adjacent to one another at least in sections in the longitudinal direction of the foundry core.

5. The foundry core according to claim 1, characterised in that separating joint runs between the two sub-segments adjacent to one another in a circumferential direction of the foundry core.

6. The foundry core according to claim 1, characterised in that as the forming elements, via which the two sub-segments adjacent to one another are fixed by positive locking immovably against one another in the at least one direction, on the edge side of a first sub-segment a projection is formed and on the edge side of a second sub-segment a recess is formed, which fills the projection of the first sub-segment.

7. The foundry core according to claim 1, characterised in that the forming elements are formed as projections protruding in a radial direction, via which adjacent sub-segments are fixed by positive locking immovably against one another in the at least one direction.

* * * * *